United States Patent [19]

Carr

[11] 4,088,825

[45] May 9, 1978

[54] ELECTRIC FURNACE WALL CONSTRUCTION

[75] Inventor: Victor H. Carr, Shelbyville, Ind.

[73] Assignee: General Electric Company, Carmel, Ind.

[21] Appl. No.: 711,555

[22] Filed: Aug. 4, 1976

[51] Int. Cl.[2] ..... F27D 1/00

[52] U.S. Cl. ..... 13/25; 13/35; 110/336; 219/536; 266/286

[58] Field of Search ..... 13/25, 20, 35; 266/286; 110/1 A; 219/531, 536, 537

[56] References Cited

U.S. PATENT DOCUMENTS

| | | | |
|---|---|---|---|
| 1,686,010 | 10/1928 | Keene | 13/25 |
| 1,861,947 | 6/1932 | Woodson et al. | 13/25 |
| 3,892,396 | 1/1975 | Monaghan | 266/286 |

*Primary Examiner*—R. N. Envall, Jr.

[57] ABSTRACT

A wall construction for an electric furnace. An outer metallic casing provides the shape and structure for the furnace and an insulating inner liner is formed of a plurality of compressibly stacked ceramic fiber batts. Electrically insulating hanger members are provided for supporting an electrical heater element within the furnace. The hanger members comprise ceramic spools mounted on elongated rods. A group of such rods are welded to a plate which is placed between a pair of adjacent batts. Means are provided for securing the plate in place for preventing movement of the hanger members. In an alternate form, the hanger members are formed, integrally with a mounting member, of ceramic.

36 Claims, 8 Drawing Figures

ELECTRIC FURNACE WALL CONSTRUCTION

I. Field of the Invention

The present invention relates to a wall structure for an electric furnace, and more particularly, to an electric furnace wall having improved means for supporting an electric heating element thereon within the furnace.

II. Description of the Prior Art

Electric ovens, and particularly those used for annealing, generally comprise large cavities having a plurality of protruding hangers suitably disposed on the inner side for receiving and holding a serpentine arrangement of electric resistance heaters. Typically, the walls of such furnaces include an outer structural layer or casing, oftentimes formed of sheet metal, and a heat insulating inner layer from which the heater hangers protrude. In the prior art, the practice has been to form this inner layer from insulating firebrick or other rather dense refractory materials while the heater hangers are secured in this inner layer. Insulating firebrick absorbs and retains large amounts of heat. Furnaces lined with such materials require excessive amounts of time and energy to reach operating temperature as well as to cool down once at operating temperature; this lowers the overall furnace efficiency and increases operating costs, including the costs of manufacturing processes wherein heating in such a furnace is a required step. Furthermore, most previous methods of supporting heating elements in a furnace having a ceramic fiber wall construction have used some dense material to support hooks or have required that the hooks extend through the insulation to the outer casing. This construction allows conduction of heat to the casing at a rate which results in rather inefficient furnace operation.

It is desirable, therefore, to provide a relatively lightweight furnace wall construction wherein heat losses to the exterior from the heater hangers and the insulating inner liner are kept at a minimum and wherein time to reach operating temperature is kept at a minimum.

Accordingly, it is an object of the present invention to provide a furnace wall of relatively lightweight construction wherein heat loss through the electrical heater hangers and through the insulating inner layer, as well as time to reach operating temperature, are kept at a minimum.

SUMMARY OF THE INVENTION

In accordance with the present invention, there is provided an improved electric furnace wall construction. A metallic outer wall portion is provided lined with a thermally insulating liner. The insulating liner includes a plurality of ceramic fiber batts compressibly layer stacked placed continguous to the outer wall portion, thus forming an inner furnace wall portion. A plurality of electrically insulating hanger members are provided for supporting an electrical heating element within the furnace. Anchoring means are provided associated with the hanger members for securing the hanger members in a projecting relationship inwardly and away from the inner furnace wall portion. The anchoring means are placed between a pair of adjacent ceramic fiber batts.

DESCRIPTION OF THE PREFERRED EMBODIMENT

Figure 1:
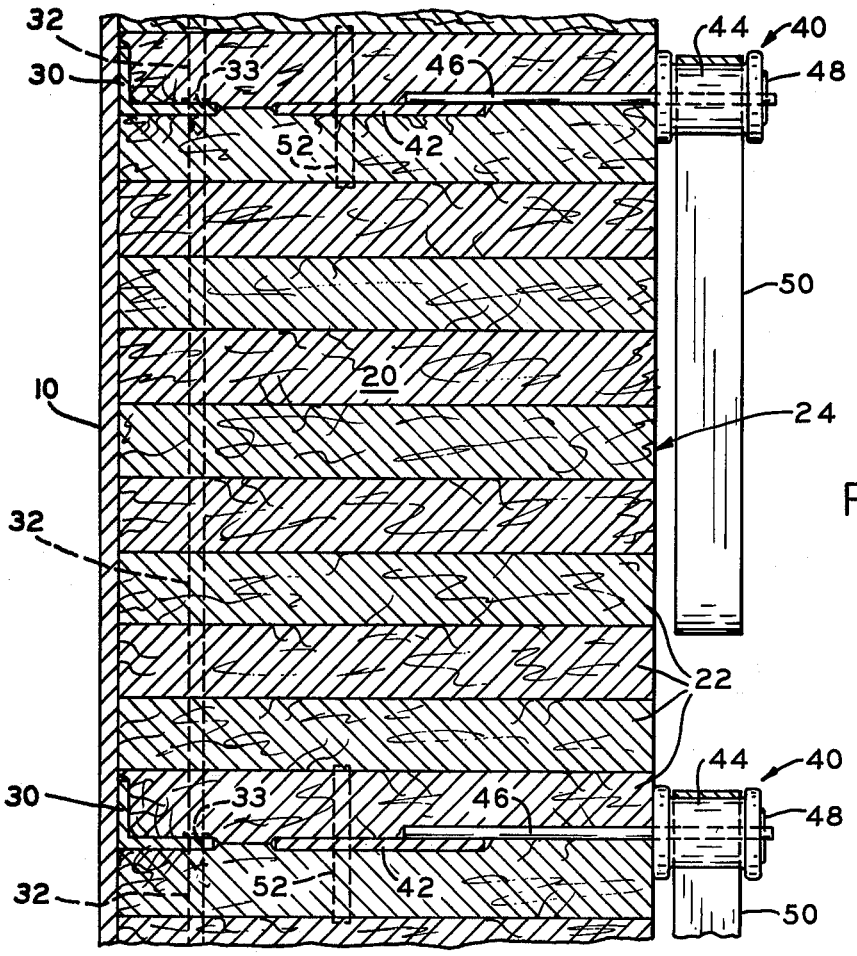
FIG. 1 is a cross-sectional view showing one form of the preferred embodiment of an electric furnace wall constructed with electric heating element hanger members and anchoring means therefor in accordance with the present invention.
Figure 2:
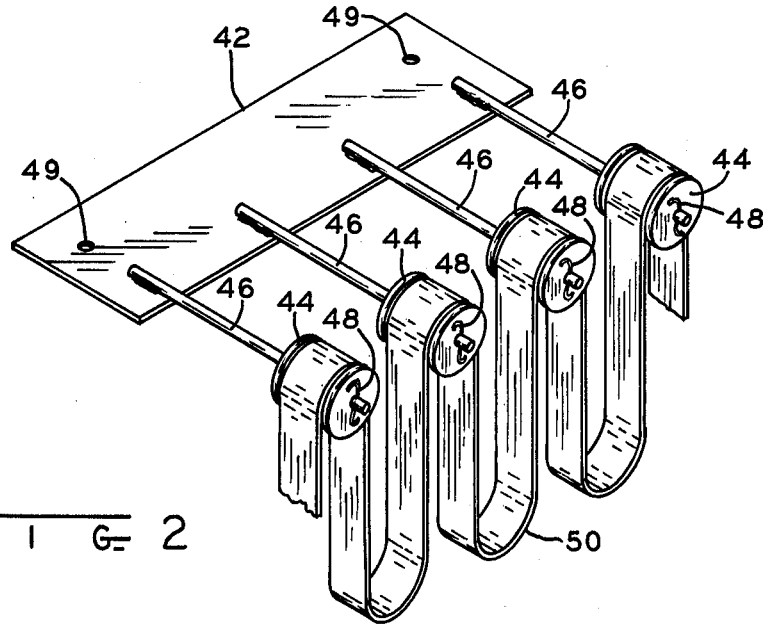
FIG. 2 is a perspective view of the heater hanger member and anchoring means assembly shown in FIG. 1.
Figure 3:
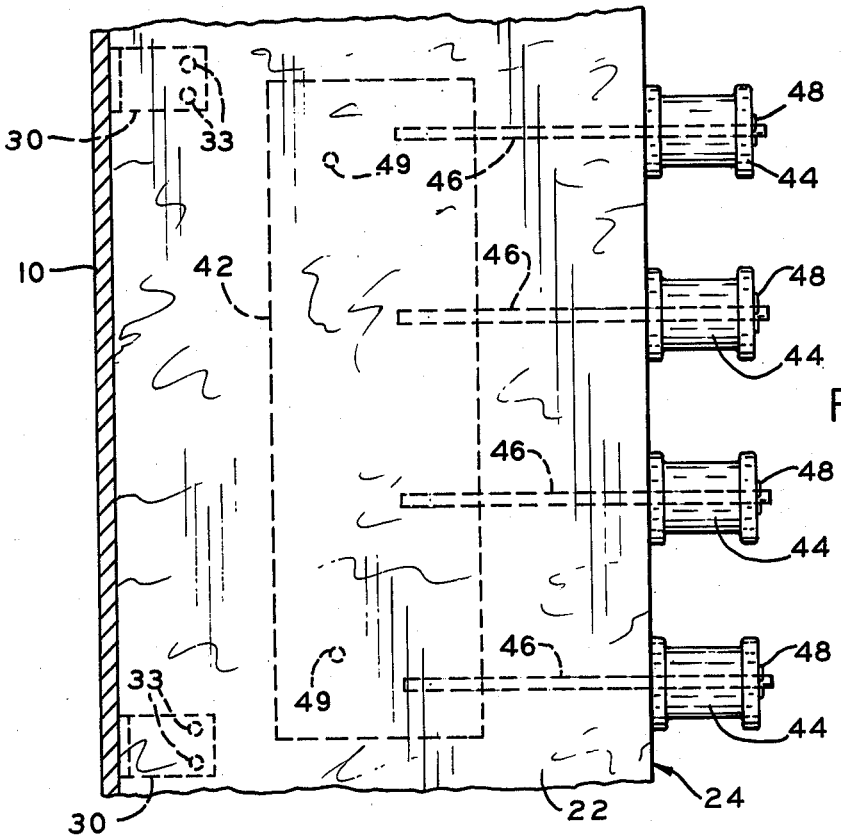
FIG. 3 is a plan view of a section of the electric furnace wall shown in FIG. 1.

In accordance with the present invention and referring generally now to FIGS. 1–3, there is shown the preferred embodiment, in one form thereof, of an improved electric furnace wall. A metallic outer wall portion in the form of a 3/16 inch thick metal casing 10 serves to define the furnace shape and to give support for the top and for the thermally insulating inner liner 20. Insulating inner liner 20 is made up of a plurality of insulating blankets in the form of ceramic fiber batts 22. Material suitable for use in this application is marketed by: Babcock and Wilcox under the trade name KAOWOOL; Johns-Manville under the trade name FIBROFRAX; and Carborundum under the trade name CERROFELT. Each batt is one inch thick before compression. These ceramic fiber batts 22 are layer stacked and compressed (ten, one inch thick batts are compressed to eight inches) to remove dead air space and to afford a certain amount of rigidity to this insulating liner. Advantageously, a plurality of inwardly projecting members in the form of angles 30 are provided secured to the inner side of metal casing 10 (as by welding). Angles 30 are appropriately spaced such that a plurality of ceramic fiber batts 22 which have been compressed may be placed in their proper positions between at least one vertical pair of angles 30 contiguous to the metal casing 10. The batts 22 are held in place by a rod 32 which is inserted into an aperture 33 on the upper angle 30 thence through the material of the ceramic fiber batts and thence to mate with another aperture 33 suitably disposed on lower angle 30. By this arrangement, the batts are retained compressibly stacked and in place against the metal casing 10.

This process is repeated with another group of ceramic fiber batts being compressibly stcked and placed between at least another pair of vertically aligned angles suitably placed and secured on the outer casing 10. In actuality, each group of ceramic fiber batts is compressibly stacked and placed between two vertical aligned pairs of such angles 30 (see FIG. 3). Another rod 32 serves to hold the second group of batts in place in like manner with a second aperture 33 being placed on the angle 30 (FIG. 3) for receiving this second rod 32.

A plurality of electrically insulating hanger members 40 are provided for supporting an electrical heating element 50 within the furnace. As shown in FIG. 2, a group of such hanger members 40 may be provided in assembly form which includes anchoring means for placement between a pair of adjacent ceramic fiber batts (as shown in FIG. 1) for securing the hanger members in a projecting relationship inwardly of the inner liner 20 and away from the inner furnace wall portion 24. In this form of the preferred embodiment, this takes the form of an elongated plate 42 secured to at least one of the hanger members 40. In this case, four such hanger members 40 are included in the assembly and take the form of ceramic spools 44 mounted on metallic rods 46. Rods 46 are in turn secured to plate 42 (as by welding). It will, of course, be recognized that the particular materials chosen will vary depending upon the temperature range which the inner side of the furnace will see. This, of course, includes the choice of the material used in the rods 46 as well as in the plate 42 and in the locking members for securing the ceramic spools 44 on the rods 46. In this form of the preferred embodiment, these locking members take the form of cotter pins 48 secured to the metallic rods 46 through holes provided therein. A pair of apertures 49 are provided in the plate 42 for receiving an elongated pin 52 (FIG. 1) which, as shown in FIG. 1, serves to engage at least one of the adjacent ceramic fiber batts 22, thereby securing the plate 42 in place and preventing the hanger members 40 from traveling from their assigned locations.

Figure 4:
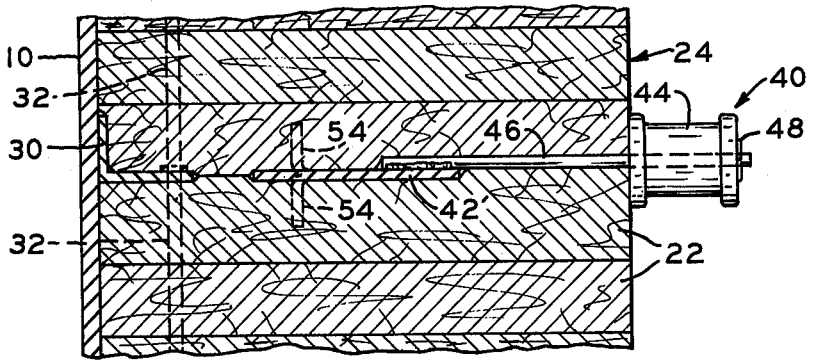
FIG. 4 is a cross sectional view showing a portion of another form of the preferred embodiment of the present invention.
Figure 5:
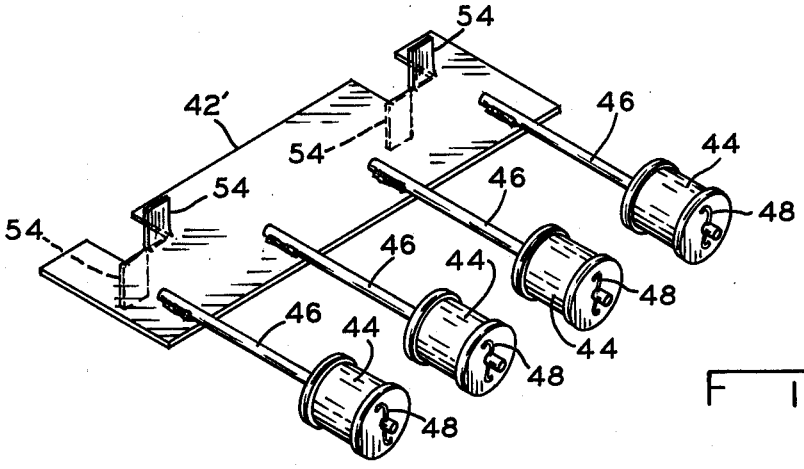
FIG. 5 is a perspective view of the electric heater hanger member and anchoring means assembly of the embodiment shown in FIG. 4.

Referring now to FIGS. 4 and 5, there is shown another form of the preferred embodiment wherein the anchoring means takes the form of a plate 42' which (as shown in FIG. 5) is provided with at least one tab for engaging at least one of the adjacent ceramic fiber batts thereby to hold the plate in place. Four such tabs 54 are provided, two of which are bent upwardly and two of which are bent downwardly and serve to bite into the adjacent ceramic fiber batts 22 preventing movement of hanger members 40 from their assigned locations.

Figure 6:
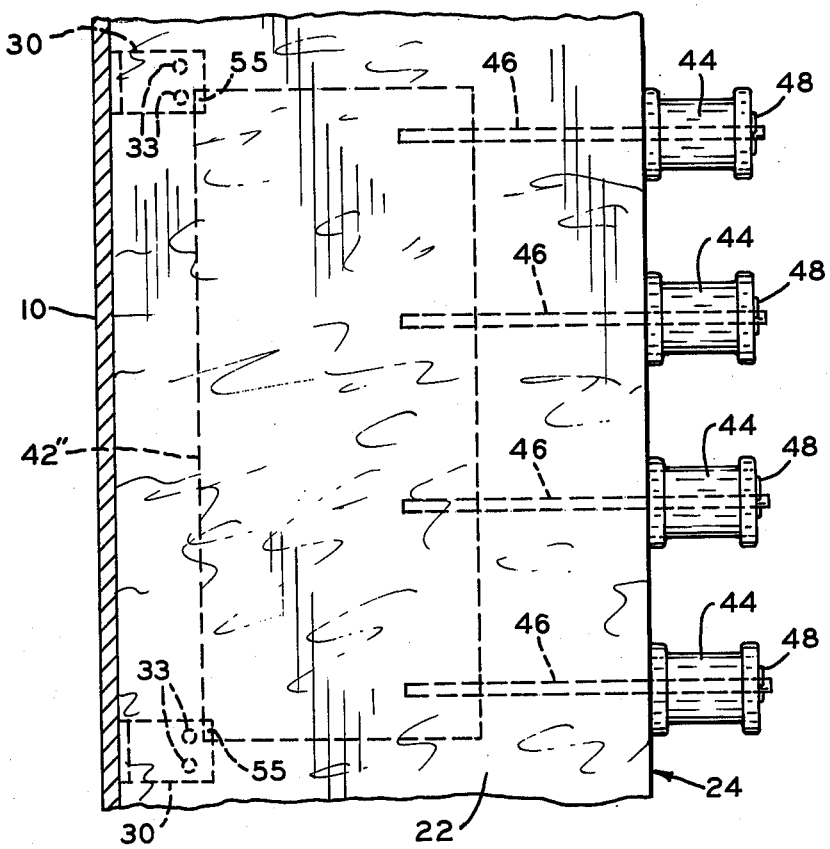
FIG. 6 is a plan view of another form of the preferred embodiment of the present invention.

Referring now to FIG. 6, there is shown yet another form of the preferred embodiment wherein the anchoring means takes the form of an elongated plate 42" to which are secured (as by welding) metallic rods 46 and thereby the ceramic spools 44 affixed thereon by cotter pins 48. Plate 42" is fixedly attached to the furnace outer wall at least at one point. As shown in FIG. 6, a pair of angles 30 are secured to the metal casing 10 (as by welding) and the plate 42" is placed between a pair of ceramic fiber batts and secured to the respective angles 30 at 55 (also by welding). Ideally, the plate 42" is provided with minimum contact to the metal casing 10 to reduce heat loss thereto; for this reason, it is suggested that the plate 42" be only lightly tacked to the angle 30.

Figure 7:
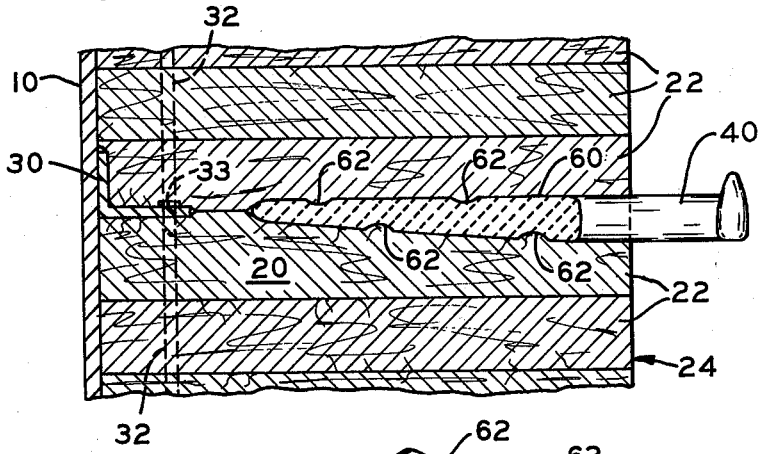
FIG. 7 is a cross sectional view showing yet another form of the preferred embodiment of the present invention.
Figure 8:
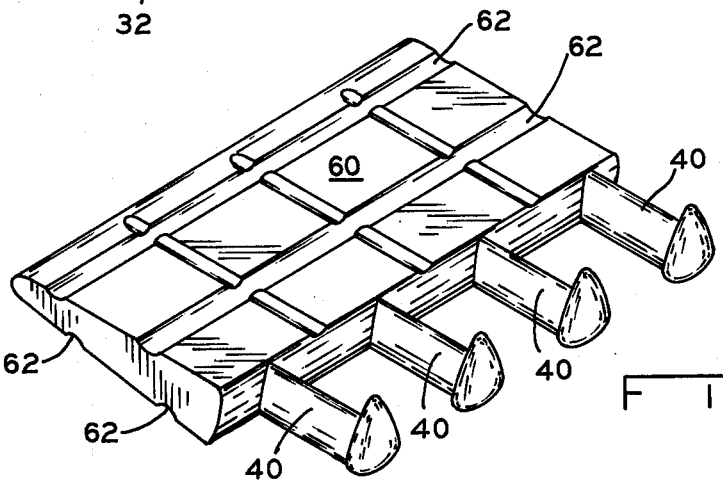
FIG. 8 is a perspective view of the electric heater hanger member and anchoring means assembly shown in FIG. 7.

Referring now to FIGS. 7 and 8, there is shown yet another form of the preferred embodiment wherein a hanger member is formed, integrally with its anchoring means, of a ceramic material. In actuality, four hanger members 40 are formed integrally with a paddle shaped member 60, paddle 60 serving as the anchoring means to retain the hanger members 40 in their proper locations with respect to the inner furnace wall portion 24 of the insulating inner liner 20. Paddle shaped member 60 is intended to be received between a pair of adjacent ceramic fiber batts 22 and is provided with at least one groove for engaging at least one of the adjacent ceramic fiber batts 22. In this form of the embodiment, a plurality of grooves 62 have been provided molded into the surface of the paddle member 60, and when a plurality of ceramic fiber batts 22 are compressibly stacked and placed contiguous to the metal casing 10, these grooves 62 will engage portions of the surfaces of the adjacent ceramic fiber batts thereby to retain the paddle and thereby the hanger members 40 in their proper locations such that the hanger members project inwardly into the furnace from the inner furnace wall portion 24. Of course, instead of providing the paddle 60 with a plurality of grooves as shown, at least one aperture may be provided through the paddle for receiving a pin such as shown in FIG. 1 for engaging at least one of the adjacent ceramic fiber batts to prevent movement of the hanger members.

The electric furnace wall construction of the present invention is not limited to the exact arrangement as illustrated. While a flat wall construction is shown, with slight modification it may be curved to provide, for example, a cylindrical furnace. Certainly the ceramic fiber batts could be stacked vertically rather than horizontally if it were so desired, and, of course, other types of insulating material may be used. The illustrated embodiments having a 6 inch thick thermally insulated liner 20 can readily withstand temperature up to 2,000 degrees F. To raise this operating temperature, it may be necessary to provide a thicker inner liner. While plate 42 of the anchoring means and the rods 46 secured thereto for holding the insulating ceramic spool hanger members have been advantageously fabricated from Inconel or other alloy, to raise the operating temperature, it may be necessary to change the materials from which these items are made. The number of hanger members mounted on a given plate may also be varied and certainly the plate could be made of expanded metal which would of itself provide means for gripping the adjacent ceramic fiber batts between which it is placed. If only one hanger member were mounted per plate, it would not even be necessary to provide the ceramic spool for insulation from the electrical resistance heater member since the ceramic fiber batts are in themselves electrically insulating.

Since the insulating ceramic fiber batts do not conduct substantial quantities of heat and since heat loss to the outer casing 10 is kept at a minimum through the teachings of the present invention, it can be seen that the outer casings of furnaces employing this construction will remain relatively cool. The efficiency of electric furnaces employing the present invention will also be enhanced since the insulating ceramic fiber batts will not store substantial quantities of heat thus reducing the times required to bring the oven up to temperature and to cool it down therefrom. It should also be recognized that this method of heating element support can be used both in new furnace construction and in the conversion of firebrick-lined furnaces to those using ceramic fiber batts, as disclosed herein.

While there has been shown and described a preferred embodiment of the electric furnace wall construction of the present invention, in the several forms thereof, it will be apparent to those skilled in the art that modifications may be made without departing from the substance of this invention and it is intended by the appended claims to cover such modifications as come within the spirit and scope of this invention.

What is claimed is:

1. In a furnace having an outer wall, a plurality of ceramic fiber batts compressibly stacked to form a thermally insulating inner liner, and a plurality of electrically insulating hanger members for supporting an electrical heating element within the furnace, the improvement comprising:

anchoring means associated with the respective hanger members and placed between a pair of adjacent ceramic fiber batts for securing the respective hanger members within the furnace in a projecting relationship inwardly of the inner liner.

2. The invention of claim 1 wherein the anchoring means includes at least one plate placed between a pair of adjacent ceramic fiber batts, the plate being secured to at least one hanger member.

3. The invention of claim 2 wherein the at least one plate including at least one aperture for receiving a pin therethrough, the pin engaging at least one adjacent ceramic fiber batt to secure the plate in place.

4. The invention of claim 2 wherein the at least one plate is provided with at least one tab for engaging at least one of the adjacent ceramic fiber batts for holding the plate in place.

5. The invention of claim 2 wherein the at least one plate is fixedly attached to the furnace outer wall at least at one point.

6. The invention of claim 1 wherein: each hanger member is formed of ceramic; and the anchoring means is formed in the shape of a paddle as an integral part of at least one hanger member.

7. The invention of claim 6 wherein the paddle includes at least one aperture for receiving a pin therethrough, the pin engaging at least one adjacent ceramic fiber batt to secure the paddle in place.

8. The invention of claim 6 wherein the paddle is provided with at least one groove for engaging at least one of the adjacent ceramic fiber batts for holding the paddle in place.

9. The invention of claim 1 wherein: the anchoring means includes an elongated plate placed between a pair of adjacent ceramic fiber batts; and each hanger member includes a ceramic spool removably attached to a rod, a plurality of rods being fixedly attached to the plate.

10. The invention of claim 9 wherein the plate includes at least one aperture for receiving a pin therethrough, the pin engaging at least one adjacent ceramic fiber batt to secure the plate in place.

11. The invention of claim 9 wherein the plate is provided with at least one tab for engaging at least one of the adjacent ceramic fiber batts for holding the plate in place.

12. The invention of claim 9 wherein the plate is fixedly attached to the furnace outer wall at least at one point.

13. The invention of claim 9 wherein: at least two angle members are secured to the furnace outer wall in a level, spaced-apart relationship; and the plate is fixedly attached to each of the angle members.

14. The invention of claim 1 wherein: each hanger member is formed of ceramic; and the anchoring means is formed of ceramic in the shape of a widened paddle integral with a portion of the plurality of hanger members.

15. The invention of claim 14 wherein the widened paddle includes at least one aperture for receiving a pin therethrough, the pin engaging at least one of the adjacent ceramic fiber batts to secure the paddle in place.

16. The invention of claim 14 wherein the paddle is provided with at least one groove for engaging at least one of the adjacent fiber batts for holding the paddle in place.

17. An electric furnace wall comprising:

a metallic outer wall portion;

a thermally insulating liner including a plurality of ceramic fiber batts compressibly layer stacked, the insulating liner being placed contiguous to the outer wall portion and forming an inner furnace wall portion;

a plurality of electrically insulating hanger members for supporting at least one electrical heating element within the furnace;

anchoring means associated with each hanger member, the anchoring means being placed between a pair of adjacent ceramic fiber batts for securing the hanger members in a projecting relationship inwardly and away from the inner furnace wall portion.

18. The invention of claim 17 wherein the anchoring means includes at least one plate secured to at least one hanger member.

19. The invention of claim 18 wherein the at least one plate includes at least one aperture for receiving an elongated pin therethrough, the pin engaging at least one adjacent ceramic fiber batt for securing the plate in place.

20. The invention of claim 18 wherein the at least one plate includes at least one tab for engaging at least one of the adjacent ceramic fiber batts for holding the plate in place.

21. The invention of claim 18 wherein the at least one plate is metallic and is secured to the metallic outer wall portion at least at one point.

22. The invention of claim 18 wherein the metallic outer wall portion includes at least one metallic inwardly projecting member; and the at least one plate is secured to the at least one metallic inwardly projecting member.

23. The invention of claim 18 wherein: the electrically insulating hanger members include, respectively, a ceramic spool removably secured to a rod; a plurality of the rods being secured to the at least one plate.

24. The invention of claim 17 wherein each hanger member is formed of ceramic; and the anchoring means is formed in the shape of a paddle as an integral part of at least one hanger member.

25. The invention of claim 24 wherein the paddle includes at least one aperture for receiving an elongated pin therethrough, the pin engaging at least one adjacent ceramic fiber batt for securing the paddle in place.

26. The invention of claim 24 wherein the paddle is provided with at least one groove for engaging at least one of the adjacent ceramic fiber batts for securing the paddle in place.

27. The invention of claim 24 wherein the anchoring means is formed as an integral part with a portion of the plurality of hanger members.

28. The invention of claim 17 wherein:

the metallic outer wall portion includes a pair of inwardly projecting members secured thereto in a vertically spaced apart relationship, each inwardly projecting member having at least one aperture therethrough, the apertures being aligned with one another; the plurality of ceramic fiber batts are compressibly layer stacked between the inwardly projecting members; and a rod is placed through the respective apertures and through the ceramic fiber batts and in engaging relationship with both inwardly projecting members for holding the ceramic fiber batts in place contiguous to the metallic outer wall portion.

29. The invention of claim 28 wherein: the first and second inwardly projecting members are spaced apart and vertically aligned, the ceramic fiber batts being compressibly layer stacked therebetween; the second and upper inwardly projecting member includes a second aperture; a third inwardly projecting member is spaced apart and vertically aligned above the second inwardly projecting member and includes an aperture in alignment with the second aperture on the second inwardly projecting member; a second portion of the plurality of ceramic fiber batts is compressibly layer stacked between the second and third inwardly projecting members; a second rod is placed through the aperture in the third inwardly projecting member thence through the ceramic fiber batts and through the second aperture in the second inwardly projecting member, the second rod maintained in engaging relationship with the second and third inwardly projecting members.

30. The invention of claim 29 wherein: the anchoring means includes an elongated plate; and, each electrically insulating hanger member includes a ceramic spool removably secured to a rod, a plurality of the rods being secured to the plate.

31. The invention of claim 30 wherein the plate includes a pair of spaced apart apertures for receiving an elongated pin therethrough, respectively, each pin engaging at least one adjcent ceramic fiber batt.

32. The invention of claim 30 wherein the plate includes a pair of spaced apart tabs for engaging at least one adjacent ceramic fiber batt.

33. The invention of claim 30 wherein the plate is secured to the outer wall portion at least at one point.

34. The invention of claim 29 wherein: each hanger member is formed of ceramic; and the anchoring means is formed of ceramic in the shape of a paddle as an integral part of at least one hanger member.

35. The invention of claim 34 wherein the paddle includes a pair of spaced apart apertures for receiving, respectively, and elongated pin therethrough, each pin engaging at least one adjacent ceramic fiber batt.

36. The invention of claim 34 wherein the paddle is provided with at least one groove for engaging at least one adjacent ceramic fiber batt.

* * * * *